US006474030B1

(12) United States Patent
Ueda

(10) Patent No.: US 6,474,030 B1
(45) Date of Patent: Nov. 5, 2002

(54) PILE FOUNDATION STRUCTURE

(75) Inventor: Sakae Ueda, Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 0 days.

(21) Appl. No.: 09/646,462

(22) PCT Filed: Feb. 3, 1999

(86) PCT No.: PCT/JP99/00447

§ 371 (c)(1),
(2), (4) Date: Sep. 19, 2000

(87) PCT Pub. No.: WO00/46451

PCT Pub. Date: Aug. 10, 2000

(51) Int. Cl.[7] ..... F02D 27/34

(52) U.S. Cl. ..... 52/292; 52/167.4; 52/167.9; 52/298; 405/229; 405/255

(58) Field of Search ..... 52/167.4, 167.9, 52/242, 294, 298, 295, 299; 405/229, 231, 230, 255, 256

(56) References Cited

U.S. PATENT DOCUMENTS 4,133,720 A * 1/1979 Franzer et al. ..... 202/223
4,938,633 A * 7/1990 Wu et al. ..... 405/229
5,014,474 A * 5/1991 Fyfe et al. ..... 52/167.8
5,531,544 A * 7/1996 Wilcox, II ..... 405/231
5,669,189 A * 9/1997 Logiadis et al. ..... 52/167.4
6,102,627 A * 8/2000 Ueda et al. ..... 405/255

FOREIGN PATENT DOCUMENTS

| | | |
|---|---|---|
| JP | 1-137076 | 5/1989 |
| JP | 10-227039 | 8/1998 |
| JP | 10-227040 | 8/1998 |

* cited by examiner

*Primary Examiner*—Carl D. Friedman
*Assistant Examiner*—Brian E. Glessner
(74) *Attorney, Agent, or Firm*—Jones, Tullar & Cooper, P.C.

(57) ABSTRACT

The present invention relates to a technique wherein a complex structure is adopted as a joint structure between each head of plural piles (1) and a bottom of a footing (2), and the complex structure may be selected among either a complex of a roller bearing structure (Y) interposing a sliding member (12) and a pin bearing structure (X) interposing a sliding member (32), another complex of a rigid joint structure (Z) and the roller bearing structure (Y), or still another complex of the rigid joint structure (Z) and a pin bearing structure (X). This can restrain the rotation of an upper structure (A), reduce stress concentration applied to a joint portion and occurrence of a bending moment on the pile (1) in applying a great external force such as an earthquake thereto, prevent damages or destroys of the joint portion and the pile, and also enhance excellent positional restoration performance for restoring the upper structure (A) to an initial position thereof, after the earthquake happens.

5 Claims, 8 Drawing Sheets

PILE FOUNDATION STRUCTURE

TECHNICAL FIELD

The present invention relates to a pile foundation structure for supporting a footing serving as a foundation of a large-scaled and heavy upper structure such as a high building, and propagating a load of the upper structure to the underground depths by means of plural point bearing piles or friction piles disposed within a construction range of the upper structure so as to be spaced from each other, and driven into the undergrounds such as a solid rock.

BACKGROUND ART

Such a pile foundation structure is conventionally known, such as the structure illustrated in FIGS. 11 and 12. In other words, it has a structure wherein plural point piles or friction piles 100 (hereinafter called piles) disposed within a construction range (shown by the outline thereof) of an upper structure A so as to be spaced from each other, is driven into the underground B, such as solid rock, and a head of the each pile 100 i.e., a pile head is buried into a foundation 101 (hereinafter called a footing) on a side of the upper structure A, whereby the pile 100 is rigidly joined to the footing 101.

FIG. 13 illustrates in detail a joint structure between each pile 100 as a structure element and the footing 101. A lower end ofthe footing 101 is mounted on a head of the pile 100, and the pile 100 is rigidly jointed to the footing 101 by reinforcing steel members 102 including a pile reinforcement and a concrete-reinforcing bar, and concrete.

As mentioned above, the conventional pile foundation structure is constructed so that each pile foundation has the pile 100 rigidly joined to the footing 101 so that it is longitudinally and laterally disposed within the construction range ofthe upper structure A, so as to be appropriately spaced from each other. In case of the conventional pile foundation structure, earthquake motion which is propagated from the underground B when an earthquake happens, is input to the upper structure A via a rigid joint portion between the head ofthe pile 100 and the footing 101. In this moment, it is not only that a stress such as a shear force is concentrated on the joint portion of the head of each pile as a boundary portion between both of them, but also that, even if joint between heads of the piles 100 and the footing 101 is perfect, a great bending moment happens on the pile 100 in the underground B. As a result, the joint portion between the pile head and the footing 101, and the pile 100 are easily damaged and destroyed. Thus, it is extremely difficult and requires a long period and huge costs to conduct a restoration construction in case that damage or destruction is caused on the pile 100, and the joint portion between the pile head and the footing 101.

In order to resolve the above problems, the pile foundation structure employing a sliding structure is suggested in a gazette of published Japanese Patent Application Laying-Open No. 1-102124.

In other words, the pile foundation structure shown in FIG. 14 is structurally described below. A number of steel reinforcement members 103 annularly disposed on an upper end of the pile 100, and steel pipes 104 disposed so as to surround the steel reinforcement members 103 in a state of allowing lateral movement of the steel reinforcement members 103 are upwardly extended. At each lower end portion of the steel pipes 104, annular engagement projections 105 are arranged so as to be connected to an upper end portion of the pile 100 in a buried state. Moreover, a top board 106 is welded to the upper end portion of the steel pipes 104, the top board 106 is provided with flexible holes 107 for making the steel reinforcement members 103 pierce the top board 106 so as to respectively allow lateral shaking of the steel reinforcement members 103. The steel reinforcement members 103 protruding above the top board 106 through the flexible holes 107, are connected to the footing 101 of the upper portion thereof. Furthermore, there is a sliding member 109 between the top board 106 and a footing metal member 108, through which the footing 101 is slidably mounted on the top board 106.

In the pile foundation structure having such a sliding arrangement, when the earthquake motion is applied, the steel reinforcement members 103 are bent, and at the moment while they are bent, the sliding member 109 makes the footing 101 slidingly move with respect to the pile 100, thereby making it possible to restrict stress concentration on the joint portion of the pile head. However, the sliding amount is regulated by the size of each flexible hole 107 disposed on the top board 106, and the pile 100 is connected to the footing 101 by the steel reinforcement members 103 whereby the shearing force and the bending moment cannot be efficiently absorbed in case of applying the excess earthquake motion. Consequently, it is unavoidable that the joint portion between the head ofthe pile 100 and the footing 101 is damaged or destroyed. In the same way as the conventional pile foundation structure in FIG. 13, there has been a problem wherein earthquake-proof property and earthquake avoidable property cannot be ensured enough.

SUMMARY OF THE INVENTION

The present invention has been conducted in view of the above mentioned circumstances, i.e., the background of the prior art. Objects of the present invention are to provide a pile foundation structure which can reduce stress concentration applied to a joint portion of a pile head and a bending moment applied to the pile which are accompanied with earthquake motion; make a whole of a structure lightweight; reduce costs; prevent the pile and the joint portion of the pile head from being damaged or destroyed; and also enhance excellent positional restoration performance of an upper structure after the earthquake happens.

A first aspect of the invention relates to a pile foundation structure for joining a footing of an upper structure to heads of plural piles (or pile heads) disposed within a construction range of the upper structure so as to be spaced from each other, and driven into the underground, characterized in that

- a roller bearing structure is constructed as each joint structure between some of the plural piles and portions of the footing of the upper structure corresponding thereto, wherein
  - a protrusive-supporting-portion having a flat top surface is disposed on a side of the pile head, in a state of protruding above an upper surface of the underground,
  - a recessed-joint-portion having a flat top surface is disposed on a side of the footing of the upper structure, so as to correspond to the protrusive-supporting-portion and be greater than the protrusive-supporting-portion, and
  - a sliding member is interposed between the top surfaces of the protrusive-supporting-portion and the recessed-jointing-portion,
- thereby making it possible to relatively slidingly move a joint portion of the head of the pile in a horizontal direction; and a pin bearing structure is constructed as each joint structure between the others of the plural piles and portions of the footing of the upper structure corresponding thereto, wherein a spherical-supporting-portion having a convex or concave outer surface is disposed on a side of the pile head, in a state of protruding above the upper surface of the underground, a spherical-joint-portion having a concave or convex inner surface is disposed on a side of the footing of the upper structure, so as to correspond to the spherical-supporting-portion and be greater than the spherical-supporting-portion, and a sliding member is interposed between the outer surface of the spherical-supporting-portion and the inner surface of the spherical-joint-portion of the footing of the upper structure, thereby making it possible to relatively slidingly rotate the joint portion of the head of the pile.

According to the first aspect of the present invention having such an arrangement, the earthquake motion which is propagated from the underground when the earthquake happens, is input to the upper structure via the each supporting portion of the roller bearing structure and the pin bearing structure in each head of the plural piles. In this time, a horizontal component of the earthquake motion is mainly absorbed by a sliding effect of the roller bearing structure wherein the protrusive-supporting-portion is disposed on a side of the pile head, and the recessed-jointing-portion is disposed on a side of the footing, and the sliding member is interposed between the flat top surfaces of the protrusive-supporting-portion and the recessed-jointing-portion, which are opposed to each other. This makes it possible to decrease the stress concentration applied to the joint portion of the pile head and a bending moment which occurs on the pile driven into the underground. On the other hand, though the upper structure is easily rotated when a great external force such as the earthquake motion is applied to the upper structure, the rotation of the upper structure can be restrained by means of the pin bearing structure wherein the spherical-supporting-portion is disposed on the pile head, the spherical-jointing-portion is disposed on the footing, so as to correspond thereto, and the sliding member is interposed between the outer surface of the spherical-supporting-portion and the inner surface of spherical-jointing-portion. Moreover, the pin bearing structure can ensure the positional restoration performance of the upper structure after the earthquake happens.

As mentioned above, the joint portion between the each head of the plural piles and the footing of the upper structure is built as a complex structure of the roller bearing structure which is excellent in the absorbing property of absorbing horizontal shakes, and the pin bearing structure which is excellent in the absorbing property of absorbing vertical shakes, and rotation restraint property. This structure can prevent the pile itself and the joint portion of the pile head from being damaged and destroyed, thereby making it possible to decrease an amount of an arrangement of reinforcement used for the pile and footing, make a whole of the structure lightweight, reduce costs, and exhibit the excellent earthquake avoidable property.

In case of employing the pile foundation structure having such a complex structure, especially, the structure which includes the roller bearing structure disposed within the construction range of the upper structure, and the pin bearing structure disposed on an outer periphery of the roller bearing structure, the external force such as the earthquake motion is applied thereto, with the result that the pin bearing structure restrains the horizontal movement of the upper structure on a side of the outer periphery of the roller bearing structure whose amount of the horizontal movement is greater than that of the portion supported by the roller bearing structure, which allows horizontal sliding movement of the upper structure. This can further improve the positional restoration performance of the upper structure after the earthquake happens.

A second invention of the present application relates to a pile foundation structure for jointing a footing of an upper structure to heads of plural piles disposed within a construction range of the upper structure so as to be spaced each other, and driven into the underground, characterized in that a rigid joint structure employing reinforcing steel material and concrete is constructed as each joint structure between some of the plural piles and portions of the footing of the upper structure corresponding thereto; and a roller bearing structure is constructed as each joint structure between the others of the plural piles and portions of the footing corresponding thereto, wherein a protrusive-supporting-portion having a flat top surface is disposed on a side of the pile head, in a state of protruding above an upper surface of the underground, a recessed-jointing-portion having a flat top surface is disposed on a side of the footing of the upper structure, so as to correspond to the protrusive-supporting-portion and be greater than the protrusive-supporting-portion, and a sliding member is interposed between the top surfaces of the protrusive-supporting-portion and the recessed-jointing-portion, thereby making it possible to relatively slidingly move a joint portion of the head of the pile in a horizontal direction.

Accordingly, in the second embodiment having such a structure, in case that the external force such as the earthquake motion propagated from the underground is applied to the upper structure when the earthquake happens, the rigid joint structure between the pile head and the footing controls the rotation of the upper structure. Moreover, when the great horizontal component accompanied with the earthquake motion or the like is applied thereto, the horizontal component is absorbed by means of the sliding effect of the roller bearing structure, thereby making it possible to decrease the stress concentration applied to the joint portion of the pile head and the bending moment occurring on the pile. As a result, when the great external force such as the earthquake motion is applied thereto, it is possible to prevent the joint portion of the pile head and the pile itself from being damaged and destroyed, and to exhibit the excellent earthquake avoidable property.

The pile foundation structure according to such a complex structure including the rigid joint structure and the roller bearing structure, may have either an arrangement wherein the roller bearing structure is disposed within the construction range of the upper structure, and the rigid joint structure is disposed on a side of the outer periphery of the roller bearing structure, or an arrangement wherein the roller bearing structure is disposed within the construction range of the upper structure, and the rigid joint structure is disposed on a side of the inner periphery of the roller bearing structure. However, the former arrangement is more preferable. Namely, in case of the former arrangement, the external force such as the earthquake motion is applied thereto, with the result that the rigid joint structure restrains the horizontal movement of the upper structure on a side of the outer periphery of the roller bearing structure whose amount of the horizontal movement is greater than that of the portion supported by the roller bearing structure, which allows horizontal sliding movement of the upper structure. This can prevent livability from worsening owing to unnecessary rocking of the upper structure, even if relatively small external forces such as a traffic vibration and a wind load are usually applied thereto. Moreover, when the great external force such as the earthquake motion is applied thereto, this can further exhibit the damage and destroy prevention functions for preventing the pile and the joint portion of the pile head from being damaged and destroyed.

A third invention of the present application relates to a pile foundation structure for jointing a footing of an upper structure to heads of plural piles disposed within a construction range of the upper structure so as to be spaced each other, and driven into the underground, characterized in that

- a rigid joint structure employing reinforcing steel material and concrete is constructed as each joint structure between a pile disposed on a side of the center of the construction range of the upper structure, among the plural piles, and a portion of the footing corresponding thereto; and
- a pin bearing structure is constructed as each joint structure between piles disposed on the outer periphery of the construction range of the upper structure and the footing of the upper structure, wherein
  - a spherical-supporting-portion having a convex or concave outer surface is disposed on a side of the pile head, in a state of protruding above the upper surface of the underground,
  - a spherical-jointing-portion having a concave or convex inner surface is disposed on a side of the footing of the upper structure, so as to correspond to the spherical-supporting-portion and be greater than the spherical-supporting-portion, and
  - a sliding member is interposed between the outer surface of the spherical-supporting-portion and the inner surface of the spherical-jointing-portion of the footing of the upper structure,
- thereby making it possible to relatively slidingly rotate a joint portion of the head of the pile.

In the third embodiment having such an arrangement, in case that the external force such as the earthquake motion propagated from the underground is applied to the upper structure when the earthquake happens, the rigid joint structure between the pile head and the footing restrains the upper structure from rotating. When the external force which is above the predetermined value is applied thereto by the earthquake motion or the like, the stress is released by sliding rotation of the pin bearing structure, thereby making it possible to decrease the stress concentration applied to the joint portion of the pile head and the bending moment occurring on the pile. This can prevent the joint portion of the pile head and the pile itself from being damaged and destroyed. Moreover, the underground is horizontally moved, there by moving the center of the gravity of the upper structure. As a result, deformation occurs on the pile in which the rigid joint structure is adopted, and vertical motion of the upper structure occurs according to the rotation of the pile head, which is built as the pin bearing structure. Consequently, the structure can ensure the positional restoration performance of the upper structure after the earthquake happens.

In the each pile foundation structure according to the first to third inventions having the above structures, a caulking compound is structurally enclosed with a sliding surface between the supporting-portion of the pile head and the jointing-portion of the footing. The caulking compound enclosed with the sliding surface between the supporting-portion of the pile head and the jointing-portion of the footing can enhance the vibration absorption property, and prevent water from intruding from the outside to the sliding surface. Accordingly, corrosion of a steel material as a structural element is decreased, and deterioration of the sliding member is decreased, thereby keeping sliding movement and sliding rotation properties caused by the sliding member smooth and stable for a long period as effects thereof.

Furthermore, the each pile foundation structure according to the first to third inventions has an arrangement wherein metal parts made of metal are respectively closely fitted into the outer surface of the supporting-portion of the head of the each pile and the inner surface of the jointing-portion of the footing, and the metal parts are integrally connected to the head of the pile and the bottom of the footing via anchor members. Then, the arrangement can have the effects of surely preventing damage and destroy of the pile head and the footing, and keeping predetermined sliding movement and sliding rotation properties smooth and stable.

In addition, according to the each pile foundation structure according to the first to third inventions having the above structures, a material having self-lubricative property is employed as the sliding member. Therefore, even in case that this is the first time that the structure, wherein a long time passed since the execution of the structure, has undergone the external force such as the earthquake, the predetermined sliding movement and sliding rotation properties are ensured.

DETAILED DESCRIPTION OF THE VARIOUS EMBODIMENTS OF THE PRESENT INVENTION

Figure 1:
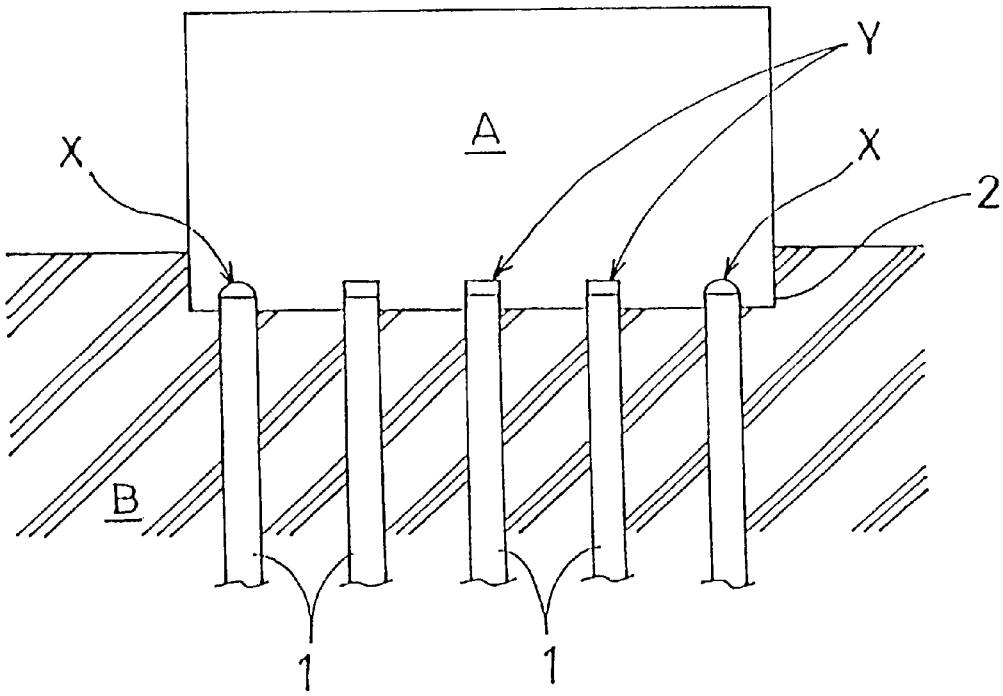
FIG. 1 is a schematic side view of a whole of a pile foundation structure in a first embodiment of the present invention.
Figure 2:
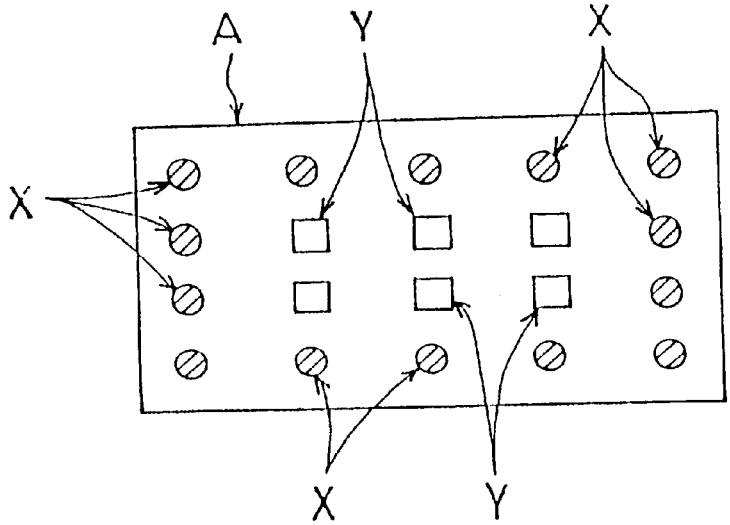
FIG. 2 is a schematic plan view of the pile foundation structure according to FIG. 1.

A first embodiment will be described. As shown in FIGS. 1 and 2, there are plural point supporting piles or friction piles 1 (hereinafter called piles) disposed within a construction range of an upper structure A (shown by the outline of the structure), so as to be spaced between the piles, which are driven into the underground B. such as solid rock. As a joint structure between each head of the piles 1 disposed on an outer periphery of the construction range thereof and a footing 2 of the upper structure A, each pin bearing structure X as shown by a circle with slant bars in FIG. 2 is adopted. On the other hand, as a joint structure between each head of the piles 1 disposed on the center of the construction range thereof and the footing 2 of the upper structure A, a roller bearing structure Y as shown by a square in FIG. 2 is adopted.

Figure 3:
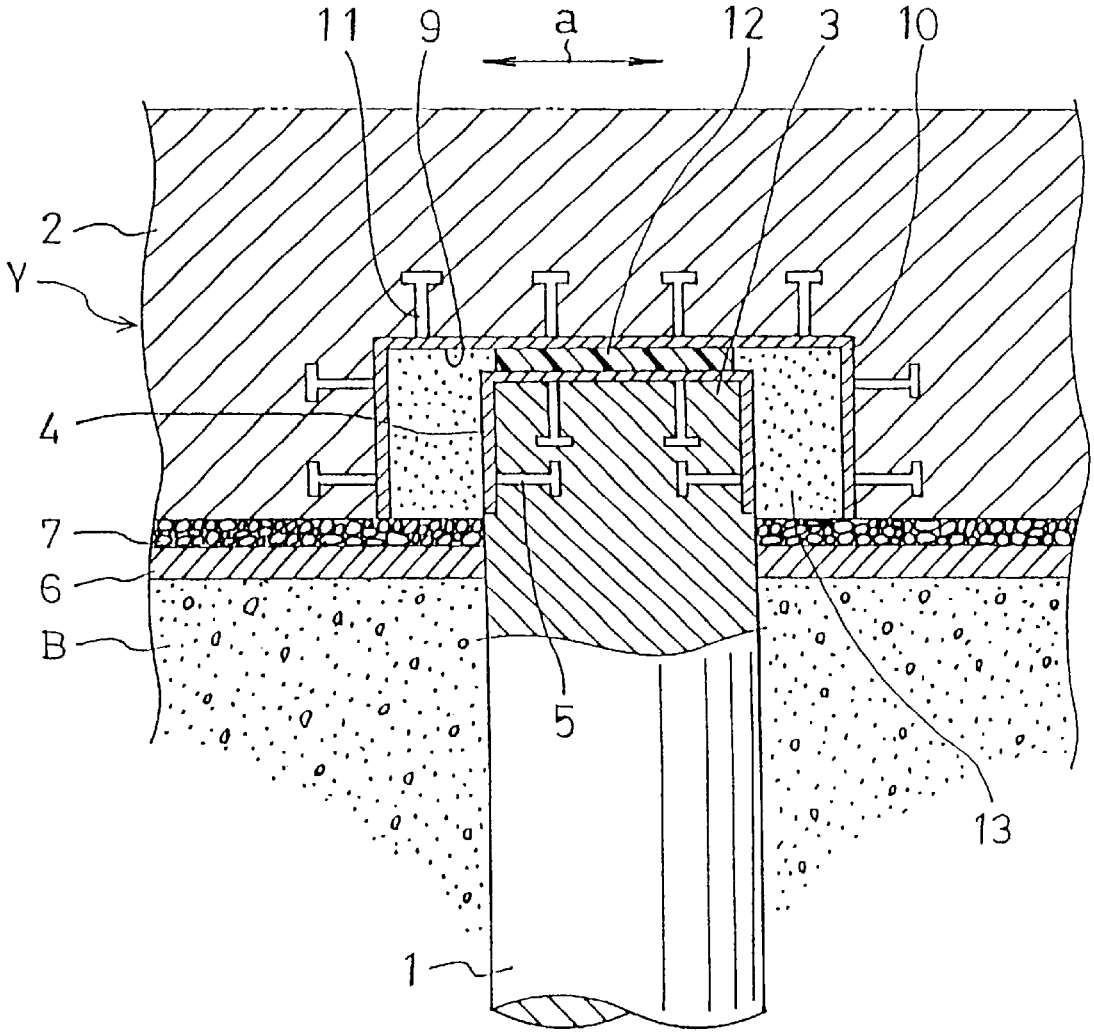
FIGS. 3 and 4 are respectively enlarged longitudinal sectional views of a main portion showing the pile foundation structure in the first embodiment of the present invention.

The roller bearing structure Y is constructed as shown in FIG. 3. In other words, a pile foundation structure shown in FIG. 1 has an arrangement wherein a head of the long pile 1 (or a pile head) made of reinforced concrete is provided with a columnar protrusive-supporting-portion 3 having a flat top surface so as to protrude above an upper surface of the underground B. A pile metal part 4 made of a protrusive-seat-shaped metal (mainly steel) corresponding thereto is closely fitted into an outer surface of the protrusive-supporting-portion 3 of the pile head. Additionally, an inner surface of the pile metal part 4 is integrally fixed and connected to the head of the pile 1 via a number of anchor members made of steel, for fixation.

A mortar seat 6 and a crushed-stone layer 7 for supporting the footing 2 so as to be movable in a horizontal direction, are laminated on an upper surface of the underground B. A portion corresponding to the head of the pile 1, in the crushed-stone layer 7 and a bottom of the footing 2 made of reinforced concrete, mounted on the head of the pile 1, is provided with a cylindrical recessed-jointing-portion 9 having a flat top surface so as to correspond to the protrusive-supporting-portion 3 and have a greater diameter than that of the protrusive-supporting-portion 3.

The footing 2 is not linked to the pile 1 by reinforcement. The footing 2 is structurally separated from the pile 1. A footing metal part 10 made of a recessed seat-shaped metal (mainly steel) corresponding thereto is closely fitted into an inner surface of the recessed-jointing-portion 9 on the bottom of the footing 2, and the outer surface of the footing metal part 10 is integrally fixed and connected to the bottom of the footing 2 via a number of anchor members 11 made of steel, for fixation.

A sliding member 12 is disposed between the flat top surfaces of the pile metal part 4 fitted and fixed in the protrusive-supporting-portion 3 on a side of the pile 1 and the footing metal part 10 fitted and fixed in an inside of the recessed-jointing-portion 9 on a side of the footing 2, thereby building a roller bearing structure for making it possible to relatively slidingly move the joint portion of the pile head in a horizontal direction, and an enclosing structure wherein a caulking compound 13 is enclosed with a sliding surface (i.e., a clearance portion except a portion for disposing the sliding member 12) between the protrusive-supporting-portion 3 on a side of the pile 1 and the recessed-jointing-portion 9 on a side of the footing 2.

For use, the sliding member 12 is adhesively bonded to a resin sheet made of fluororesin or polyethylene resin or the like, or it is coated with the fluororesin or the polyethylene resin. In addition, a solid lubricating material including a carbon material and a molybdenum material may be applied to the sliding surface of the resin sheet. Anyway, as the sliding member 12, a material having self-lubricating property is employed.

Preferably, a material employed as the caulking compound 13 is a sealant material, a rubber packing or the like, having superiority in cut-off of water property and vibration absorbing property.

Figure 4:
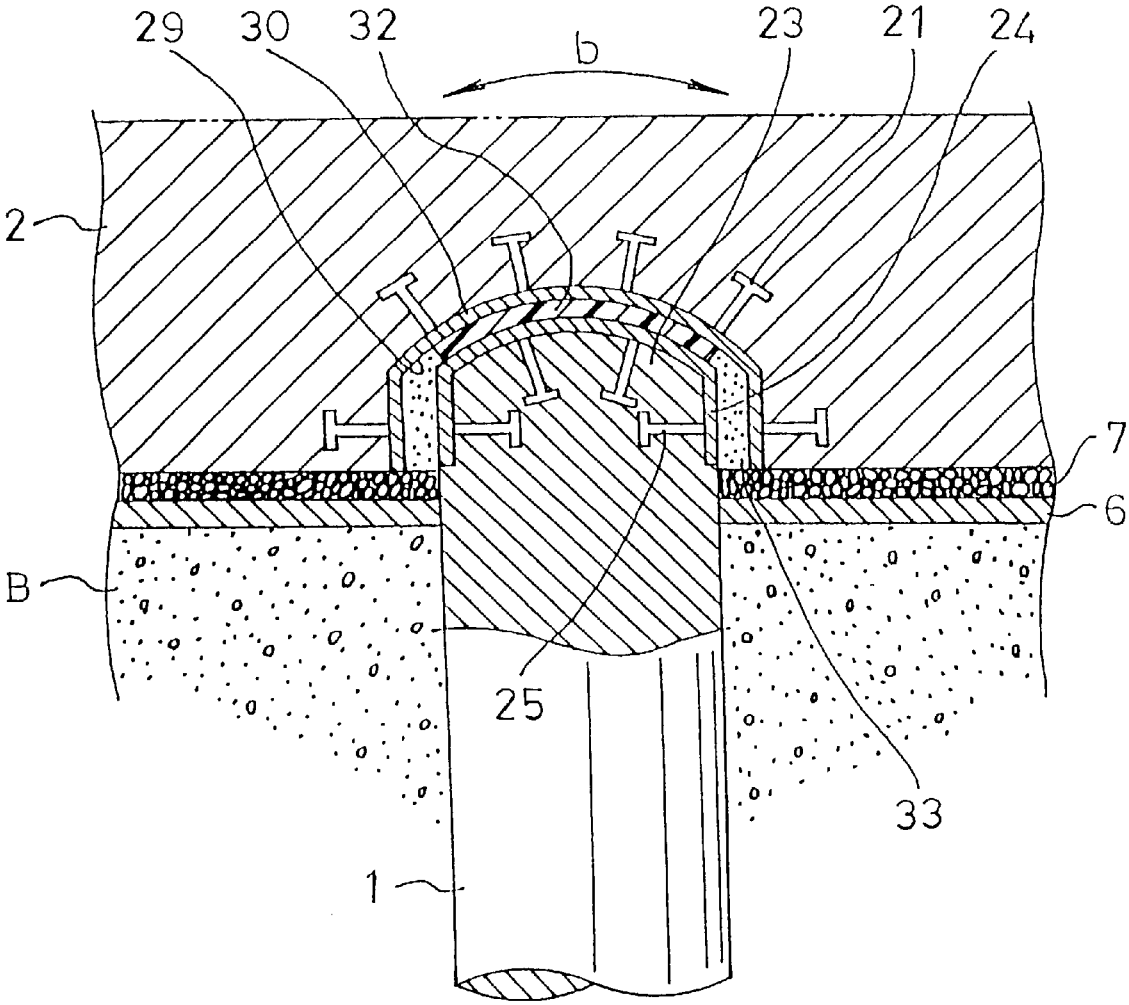

On the other hand, the pin bearing structure X is built as shown in FIG. 4. In other words, the head of the pile 1 made of reinforced concrete is provided with a spherical-supporting-portion being convex shaped, having a spherical top surface, so as to protrude above the upper surface of the underground B. In an outer surface of the spherical-supporting-portion 23, a convex seat-shaped pile metal part 24 corresponding thereto is fitted. An inner surface of the pile metal part 24 is integrally connected to the head of the pile 1 via a number of anchor members 25 made of steel, for fixation. On the bottom of the footing 2 made of reinforced concrete, a concave spherical-jointing-portion 29 having a spherical top surface is disposed, so as to correspond to the convex spherical-supporting-portion 23 of the head of the pile 1 and have a greater diameter than that of the corresponding spherical-supporting-portion 23. In an inner surface of the spherical-jointing-portion 29, a footing metal part 30 being concave seat-shaped, corresponding thereto, is fitted. An outer surface of the footing metal part 30 is integrally connected to the bottom of the footing 2 via a number of anchor members 21 made of steel, for fixation.

Between vertically opposite spherical surfaces of the pile metal part 24 on a side of the pile 1 and the footing metal part 30 on a side of the footing 2, a sliding member 32 is interposed, thereby building the pin bearing structure for making it possible to relatively slidingly rotate the joint portion of the pile head, and an enclosing structure wherein a caulking compound 33 is enclosed with a sliding surface (i.e., a clearance portion except a portion for disposing the sliding member 32) between the convex spherical-supporting-portion 23 on a side of the pile 1 and spherical-jointing-portion 29 on a side of the footing 2.

Moreover, the pin bearing structure X has an arrangement wherein the crushed-stone layer 7 as well as the mortar seat 6 are laminated between the upper surface of the underground B and the bottom of the footing 2. Furthermore, as to the sliding member 32 and the caulking material 33, the same materials as those used in the roller bearing structure Y are employed.

As mentioned above, a center area □ within the construction range of the upper structure A is provided with the roller bearing structure Y wherein the bottom of the footing 2 and the head of the pile 1 can be relatively slidingly moved in horizontal two dimensional directions including lateral and longitudinal directions (i.e., the arrow "a" direction and the cross dots direction in FIG. 3), and the outer periphery thereof is provided with the pin bearing structure X wherein the bottom of the footing 2 and the head of the pile 1 can be relatively slidingly rotated along the spherical-supporting-portion 23 and the spherical-jointing-portion 29 in all directions (i.e., the direction of the arrow "b" in FIG. 4). In other words, a pile foundation structure based on a complex structure of including the roller bearing structure and the pin bearing structure is adopted, whereby a horizontal component of earthquake motion is mainly absorbed by a sliding effect of the roller bearing structure Y. This makes it possible to decrease stress concentration applied to the joint portion of the pile head and the bending moment which occurs on the pile 1 driven into the underground B. On the other hand, the pin bearing structure X can restrain the upper structure A accompanied with an effect of great external forces of the earthquake motion or the like from rotating. Moreover, the pin bearing structure X can ensure positional restoration performance of the upper structure A after the earthquake happens.

Accordingly, even in applying a great external force such as an earthquake, the present invention can prevent the head of the pile 1 and the footing 2 from being damaged and destroyed, thereby ensuring earthquake proofing property, and earthquake avoidable property, whereby an amount of arrangement of reinforcement, employed as the pile 1 and the footing 2, can be decreased so as to make a whole of the pile foundation structure lightweight, execution can be enhanced and costs thereof can be decreased.

Furthermore, the crushed-stone layer 7 is formed on a side of the lower surface of the footing 2 of the roller bearing structure Y for absorbing the horizontal component and the pin bearing structure X. As a result, the pile foundation structure is isolated from the underground B, thereby exhibiting the earthquake avoidable property with the result that a seismic force and the lateral shaking of the upper structure are extremely reduced. Accordingly, the livability is improved, and the damage preventive effect is further enhanced.

In addition, structurally, the caulking compound 13, 33 is enclosed with the respective sliding surfaces between the protrusive-supporting-portion 3 of the head of the pile 1 and the recessed-jointing-portion 9 of the bottom of the footing 2 and between the convex spherical-supporting-portion 23 on a side of the pile 1 and the concave spherical-jointing-portion 29 on a side of the footing 2. The caulking compound 13, 33 enhances the vibration absorbing property, and prevents water or the like from intruding from the outside to the sliding surface. Therefore, this can decrease corrosion of the steel material as the element materials including the pile metal part 4, 24 and the footing metal part 10, 30, and deterioration of the sliding member 12, 32, and keep the sliding movement property smooth and stable for a long time.

Figure 5:
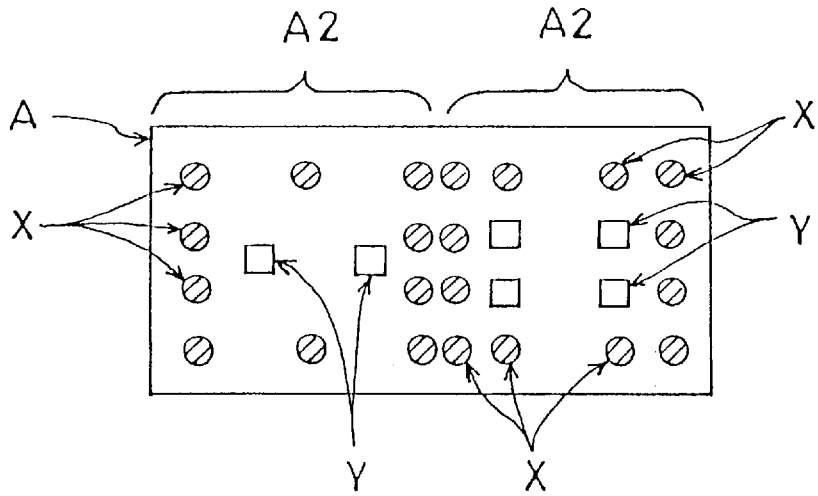
FIGS. 5 to 7 are respectively whole schematic plan views showing modifications of the pile foundation structure according to the first embodiment of the present invention.

Furthermore, the pile foundation structure shown in the above first embodiment is described as the complex structure wherein the pin bearing structure X is arranged on the outer periphery of the construction range of the upper structure A, and the roller bearing structure Y is arranged on the center area thereof. This structure is suitable for a case wherein the upper structure A is substantially square in a plan view, and the center of gravity is positioned in the center of the construction range thereof On the other hand, in case that the upper structure A is substantially square in plan view, the weight of the upper structure A is unbalanced in the right and left of the drawing, and the center of gravity is biased and positioned on a heavier side thereof it is preferable to adopt the complex structure as shown in FIG. 5, wherein the arrangement of the roller bearing structures Y in a structure zone A1 which is the heavier side in the construction range of the upper structure A is different from that in a structure zone A2 which is the lighter side in the construction range thereof, and the pin bearing structures X are arranged so as to surround the outer periphery of the roller bearing structure Y in the each zone A1, A2.

Figure 6:
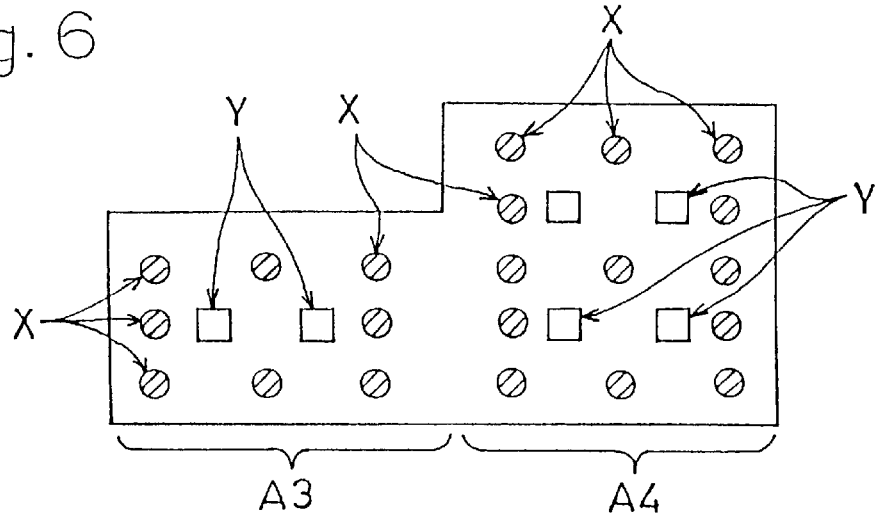

Furthermore, in case that the upper structure A is large-sized to be bent in a substantial L-shape in a plan view, it is preferable to adopt the complex structure as shown in FIG. 6. In other words, the roller bearing structures Y in a structure zone A3 of one side of the bent portion and a structure zone A4 of the other side of the bent portion are respectively varied in the arrangement and the number thereof, and the pin bearing structures X are arranged so as to surround the outer periphery of the roller bearing structure Y of the each structure zone A3, A4.

Figure 7:
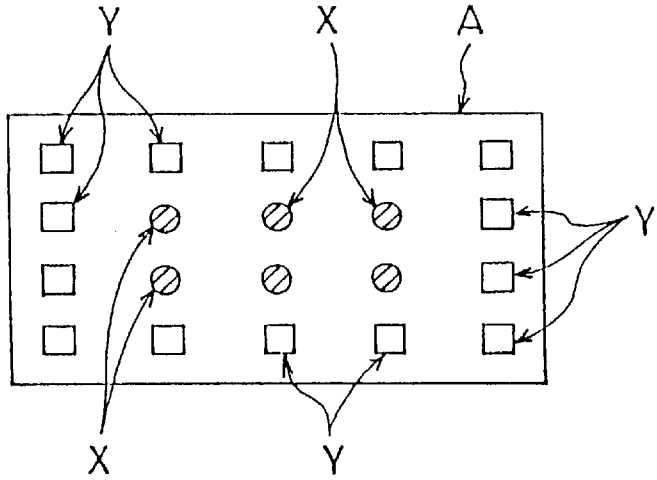

To the contrary to the pile foundation structure of the first embodiment, it may have almost the same effect as the above to adopt the complex structure as shown in FIG. 7, wherein the each roller bearing structure Y is arranged on the outer periphery of the construction range of the upper structure A and the each pin bearing structure X is arranged on the center area thereof.

Figure 8:
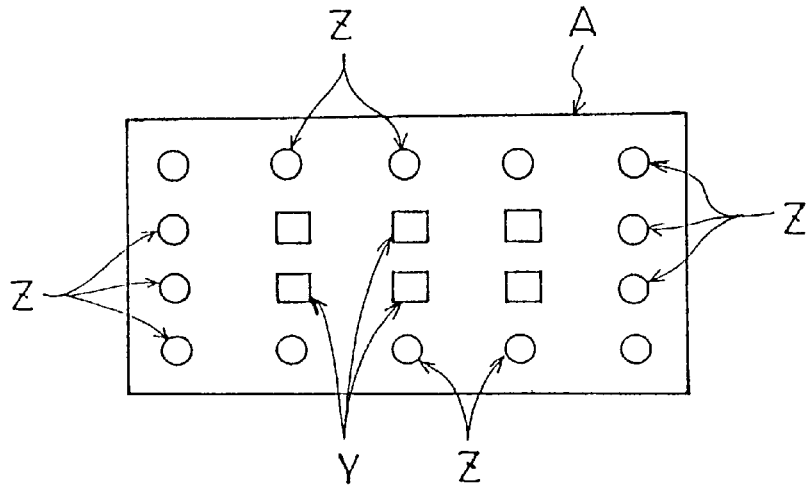
FIG. 8 is a schematic plan view of a whole of the pile foundation structure in a second embodiment of the present invention.

To the contrary to the pile foundation structure of the first embodiment, it may have almost the same effect as the above to adopt the complex structure as shown in FIG. 7, wherein each roller bearing structure Y is arranged on the outer periphery of the construction range of the upper structure A and the each pin bearing structure X is arranged on the center area thereof FIG. 8 shows a second embodiment of the present invention. In the pile foundation structure of the second embodiment, each rigid joint structure Z shown by an outlined circle in FIG. 8 is adapted as a joint structure for joining the head of the pile 1 positioned on the outer periphery of the construction range of the upper structure A to the footing 2 on a side of the upper structure A. On the other hand, each roller bearing structure Y shown by a square in FIG. 8 is adopted on a side of the center area of the construction range.

Figure 13:
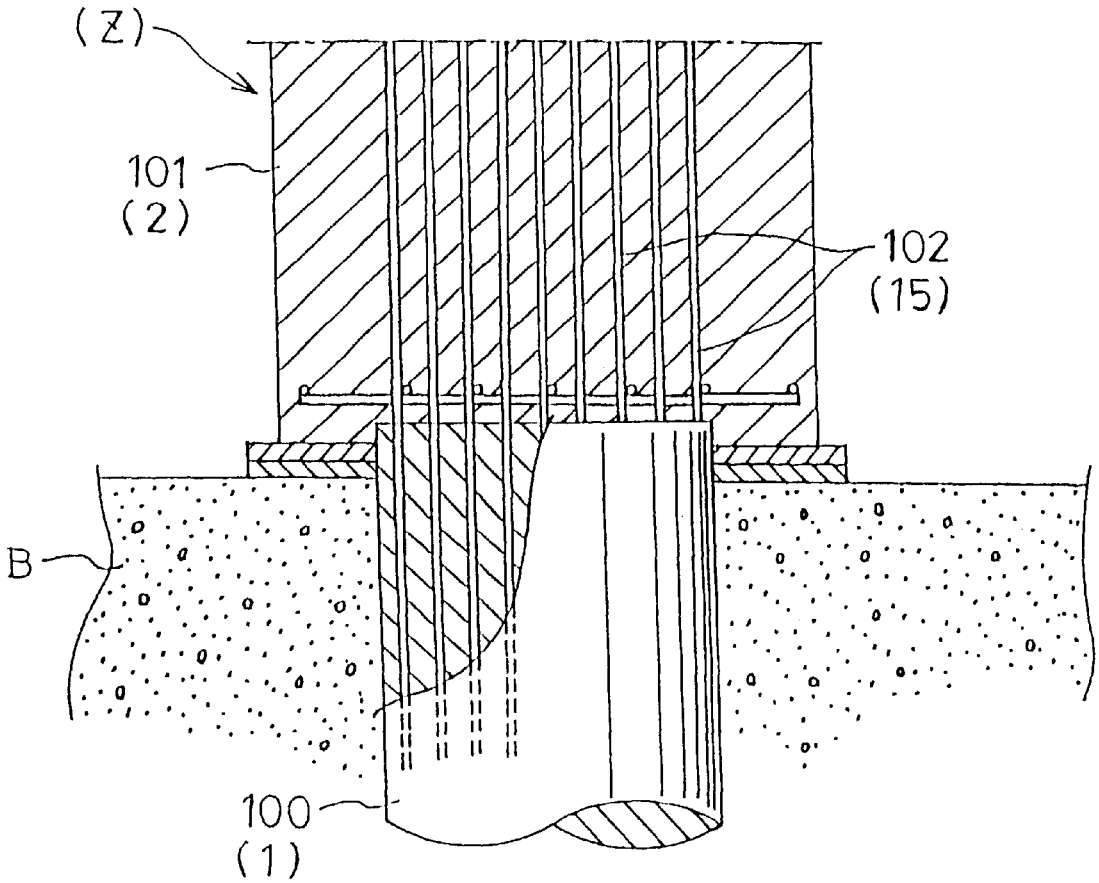
Fig. 13 PRIOR ART
FIG. 13 is an enlarged longitudinal sectional view of a main portion of the general pile foundation structure according to the prior art.
Figure 14:
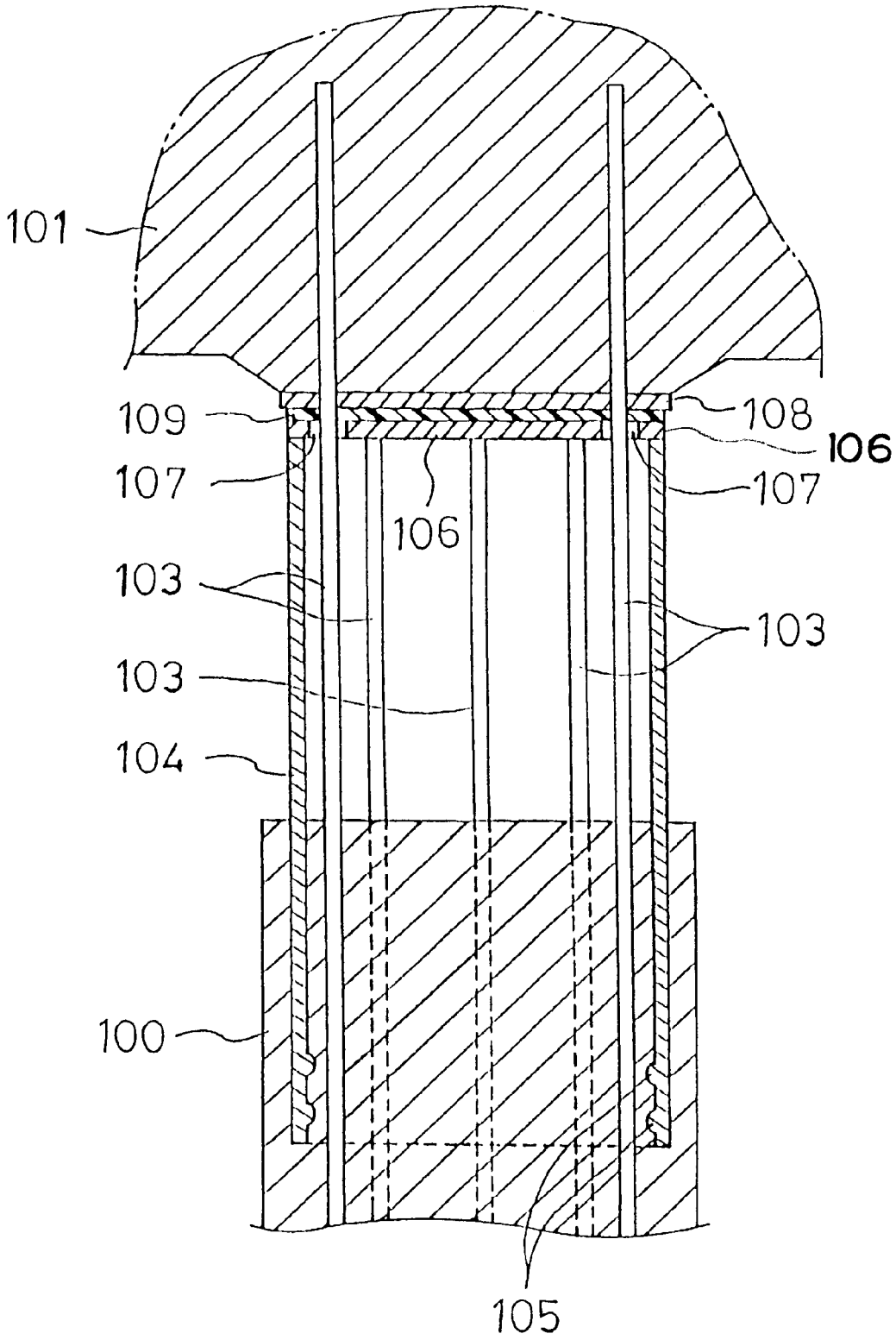
Fig. 14 PRIOR ART
FIG. 14 is an enlarged longitudinal sectional view of a main portion showing a pile foundation structure already suggested in the prior art.

In the same way as the structure illustrated in FIG. 13, a lower end of a footing 101 (2) is mounted on a head of a pile 100 (1), and the pile 100 (1) is rigidly joined to the footing 101 (2) by a reinforcing steel member 102 (15) including a pile reinforcement and a concrete-reinforcing bar, and concrete. Herein, references in parentheses are elements in the rigid joint structure Z of the second embodiment.

Moreover, the roller bearing structure Y is identical to one illustrated in FIG. 3. Therefore, the detail description of the structure is omitted.

As mentioned above, the complex structure including the rigid joint structure Z and the roller bearing structure Y is adopted. In other words, the center area of the construction range of the upper structure A is provided with the rigid joint structure Z, wherein the bottom of the footing 2 is rigidly joined to the head of the pile 1 via the reinforcing steel member and the concrete, while the outer periphery thereof is provided with the roller bearing structure Y wherein the bottom of the footing 2 and the head of the pile 1 can be relatively slidingly moved in the horizontal two dimensional directions including lateral and longitudinal directions (i.e., the arrow "a" direction and the cross dots direction in FIG. 3) Accordingly, in case that the external force such as the earthquake motion propagated from the underground B is applied to the upper structure A when the earthquake happens, the rigid joint structure Z restrains the outer periphery of the upper structure A which moves on a larger scale than the center area thereof from horizontally moving and rotating. This can prevent livability from worsening owing to unnecessary rocking of the upper structure A, even if the relatively small external forces such as the traffic vibration and the wind load are applied thereto. Moreover, when the great horizontal component accompanied with the earthquake motion or the like is applied thereto, the horizontal component is absorbed by means of the sliding effect of the roller bearing structure Y, thereby making it possible to decrease the stress concentration applied to the joint portion of the pile head and the bending moment occurring on the pile 1. As a result, when the great external force such as the earthquake motion is applied thereto, it is possible to prevent the joint portion of the pile head and pile 1 itself from being damaged and destroyed, and to exhibit the excellent earthquake avoidable property.

Figure 9:
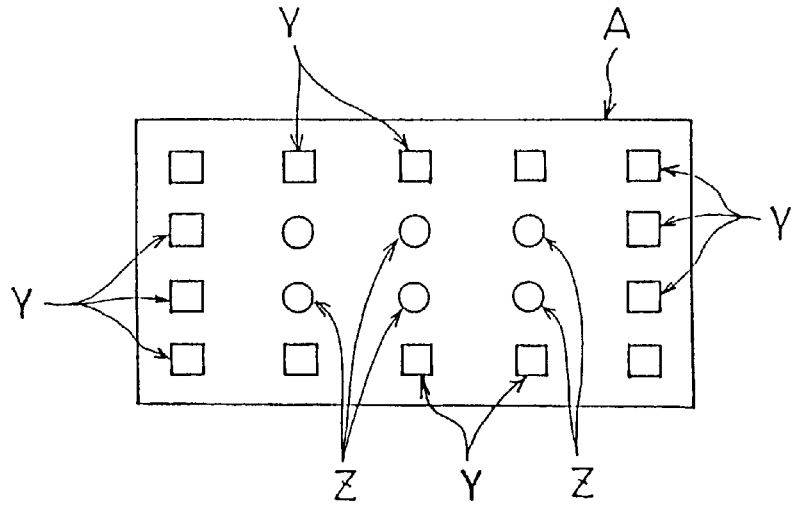
FIG. 9 is a whole schematic plan view showing a modification of the pile foundation structure in the second embodiment of the present invention.

In the pile foundation structure according to the second embodiment, the complex structure has been described, wherein the outer periphery of the construction range of the upper structure A is provided with the rigid joint structure Z, and the center area thereof is provided with the roller bearing structure Y. To the contrary, it may have almost the same effect and action as the above embodiment to adopt the complex structure as shown in FIG. 9, wherein the outer periphery of the construction range of the upper structure A is provided with the roller bearing structure Y, and the center area thereof is provided with the rigid joint structure Z.

Moreover, in case that the center of gravity is out of the center of the upper structure A so as to be biassedly positioned on one side even if the plan view of the upper structure A is substantially rectangular, or in case that the upper structure A is large-sized to be bent in a substantial L-shape in a plan view, it is preferable to adopt the complex structure wherein the each roller bearing structure Y is arranged as shown in FIGS. 5 and 6, and the each rigid joint structure Z is arranged so as to surround the outer periphery of the roller bearing structure Y according to the each embodiment.

Figure 10:
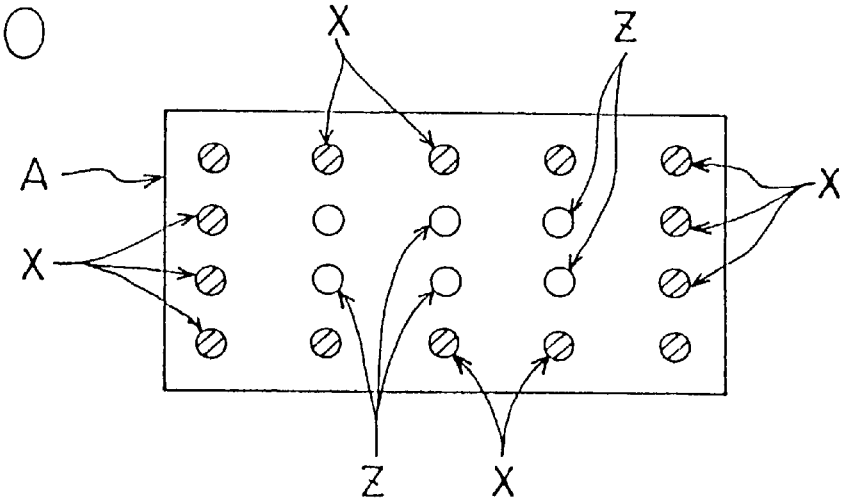
FIG. 10 is a schematic plan view of a whole of a pile foundation structure in a third embodiment of the present invention.
Figure 11:
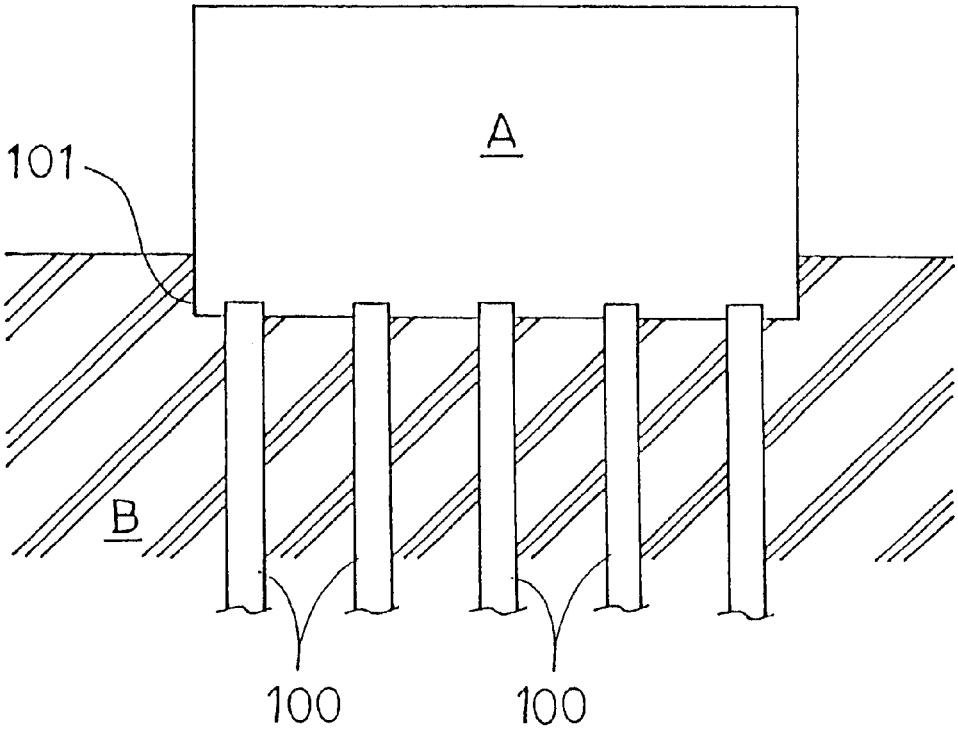
Fig. 11 PRIOR ART
FIG. 11 is a whole schematic side view showing a general pile foundation structure according to the prior art.
Figure 12:
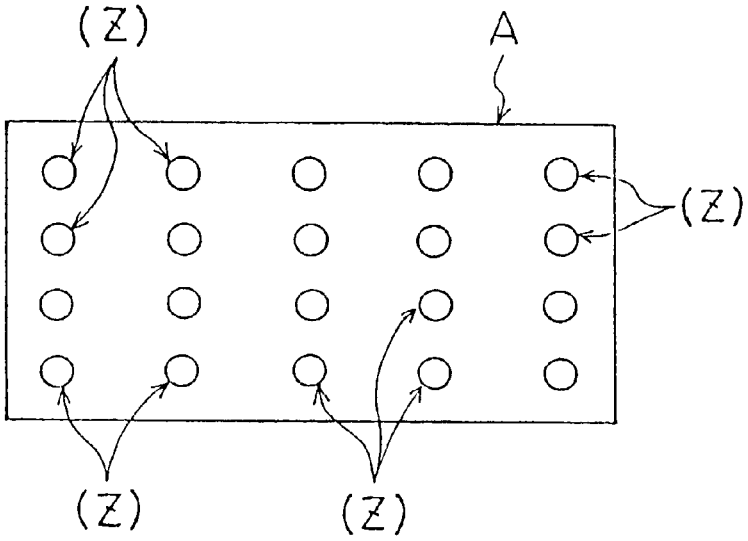
Fig. 12 PRIOR ART
FIG. 12 is a schematic plan view of the pile foundation structure shown in FIG. 11.

FIG. 10 illustrates a third embodiment of the present invention.

In the pile foundation structure of the third embodiment, each rigid joint structure Z shown by an outlined circle in FIG. 10 is adopted as a joint structure for joining the head of the pile 1 positioned on the center area of the construction range of the upper structure A to the footing 2 on a side of the upper structure A, while each pin bearing structure X shown by a circle with slant bars shown in FIG. 10 is arranged on a side of the outer periphery of the construction range.

In the same way as the structure illustrated in FIG. 13 of the second embodiment, the lower end of the footing 2 is mounted on the head of the pile 1, and the pile 1 is rigidly joined to the footing 2 with the reinforcing steel member 15 including a pile reinforcement and a concrete-reinforcing bar, and the concrete.

In addition, the pin bearing structure X is identical to one illustrated in FIG. 4. Therefore, the detail description of the structure is omitted.

As mentioned above, the complex structure including the rigid joint structure Z and the pin bearing structure X is adopted. In other words, the center area of the construction range of the upper structure A is provided with the rigid joint structure Z, wherein the bottom of the footing 2 is rigidly joined to the head of the pile 1 via the reinforcing steel member and the concrete, while the outer periphery thereof is provided with the pin bearing structure X wherein the bottom of the footing 2 and the head of the pile 1 can be relatively slidingly rotated along the spherical-supporting-portion 23 and the spherical-jointing-portion 29 in all directions (i.e., the direction of the arrow "b" in FIG. 4). Accordingly, in case that the external force such as the earthquake motion propagated from the underground B is applied to the upper structure A when the earthquake happens, the rigid joint structure Z restrains the upper structure A from rotating. When the external force which is above the predetermined value is applied thereto by the earthquake motion or the like, the stress is released by sliding rotation of the pin bearing structure X, thereby making it possible to decrease the stress concentration applied to the joint portion of the pile head and the bending moment occurring on the pile. This can prevent the joint portion of the pile head and the pile 1 itself from being damaged and destroyed. Moreover, the underground B is horizontally moved, thereby moving the center of the gravity of the upper structure A. As a result, deformation occurs on the pile 1 in which the rigid joint structure Z is adopted, and vertical motion of the upper structure A occurs according to the rotation of the pile head, which is built as the pin bearing structure X. Consequently, the structure can ensure the positional restoration performance of the upper structure A after the earthquake happens.

Though the pin bearing structure X described in the first and third embodiments has an arrangement wherein the spherical-supporting-portion 23 of the head of the pile 1 is shaped into convexity, and the spherical-jointing-portion 29 of the bottom of the footing 2 is shaped into concavity, it may have the reversed arrangement wherein the spherical-supporting-portion 23 of the head of the pile 1 is shaped into concavity, and the spherical-jointing-portion 29 of the bottom of the footing 2 is shaped into convexity. Then, the latter arrangement can have the same action and effect as the former one.

As mentioned above, the pile foundation structure according to the present invention relates to a technique wherein a complex structure i.e., any of a roller bearing structure and a pin bearing structure, a rigid joint structure and the roller bearing structure or the rigid joint structure and the pin bearing structure, is disposed between a supporting portion of a pile head for propagating a load of an upper structure to the underground depths, and a joint-portion of a bottom of a footing. This can reduce stress concentration applied to the joint portion of the pile head and bending moment applied to the pile which are accompanied with the earthquake motion, make a whole of the structure lightweight, reduce costs, and prevent the pile and the joint portion of the pile head from being damaged or destroyed. Moreover, this is the technique for improving the positional restoration performance of the upper structure A after the earthquake happens.

What is claimed is:

1. A pile foundation structure joining a footing of an upper structure to heads of plural piles disposed within a construction range of the upper structure so as to be spaced from each other, and driven into the underground, the improvement comprising:

a roller bearing structure constructed as a joint structure disposed within the construction of the upper structure between some of the plural piles and portions of the footing of the upper structure corresponding thereto, wherein:

a protrusive-supporting-portion having a flat top surface is disposed on a side of the head of the pile, in a state of protruding above an upper surface of the underground;

a recessed-joint-portion having a flat top surface is disposed on a side of the footing of the upper structure, so as to correspond to the protrusive-supporting-portion and be greater than the protrusive-supporting-portion; and a sliding member is interposed between the top surfaces of the protrusive-supporting-portion and the recessed-joint-portion, for relatively slidingly move a joint portion of the head of the pile in a horizontal direction; and a pin bearing structure is constructed as each joint structure and disposed on the outer periphery of the roller bearing structure and between the others of the plural piles and portions of the footing of the upper structure corresponding thereto, wherein:

a spherical-supporting-portion having a convex or concave outer surface is disposed on a side of the head of the pile, protruding above the upper surface of the underground, a spherical-joint-portion having a concave or convex inner surface is disposed on a side of the footing of the upper structure, so as to correspond to the spherical-supporting-portion and be greater than the spherical-supporting-portion; and a sliding member is interposed between the outer surface of the spherical-supporting-portion and the inner surface of the spherical-joint-portion of the footing of the upper structure, to relatively slidingly rotate the joint portion of the head of the pile.

2. A pile foundation structure according to claim 1, wherein a crushed-stone layer for supporting the footing of the upper structure so as to be horizontally movable, is formed between a bottom surface of the footing of the upper structure and the upper surface of the underground.

3. A pile foundation structure according to claim 1, wherein a caulking compound is enclosed with respective sliding surfaces between the protrusive-supporting-portion of the head of the pile and the recessed-joint-portion, constructed as the roller bearing structure, and between the spherical-supporting-portion of the head of the pile and the spherical-joint-portion, constructed as the pin bearing structure.

4. A pile foundation structure according to claim 1, wherein metal parts made of metal are respectively closely fitted into an outer surface of the protrusive-supporting-portion on a side of the head of the pile and an inner surface of the recessed-joint-portion of the bottom portion of the footing, constructed as the roller bearing structure; and the outer surface of the spherical-supporting-portion on a side of the head of the pile and the inner surface of the spherical-joint-portion, constructed as the pin bearing structure, and the metal parts are integrally connected to the head of the pile and the bottom of the footing via anchor members.

5. A pile foundation structure according to claim 1, wherein the sliding member is made of a material being self-lubricative.

* * * * *